US005885194A

United States Patent [19]

Wasserman et al.

[11] Patent Number: 5,885,194

[45] Date of Patent: Mar. 23, 1999

[54] ATTACHMENT SYSTEM FOR SUSPENDING AN EXERCISE AND/OR THERAPY APPARATUS IN A POOL OF LIQUID

[75] Inventors: Jack F. Wasserman; Frank H. Speckhart, both of Knoxville, Tenn.; Alan Scott; Wil Siersma, both of Carbondale, Colo.

[73] Assignee: Hydroforce, Inc., Knoxville, Tenn.

[21] Appl. No.: 797,402

[22] Filed: Feb. 10, 1997

Related U.S. Application Data

[62] Division of Ser. No. 638,500, Apr. 26, 1996.

[51] Int. Cl.[6] ..... A63B 21/008

[52] U.S. Cl. ..... 482/111; 482/70; 482/904

[58] Field of Search ..... 402/111, 904, 402/70

[56] References Cited

U.S. PATENT DOCUMENTS 5,050,863 9/1991 Yacoboski ..... 482/111

*Primary Examiner*—Lynne A. Reichard
*Attorney, Agent, or Firm*—Michael E. McKee

[57] ABSTRACT

A ski-type exercise or therapy apparatus for use with liquid contained within a pool having walls utilizes a frame positionable in a stationary condition with respect to the walls of the pool and a pair of pump assemblies wherein each pump assembly includes a piston and a cylinder within which the piston is slidably received for movement therealong in conjunction with the movement of a corresponding foot of an individual between two positions of movement. A port provides flow communication between the interiors of the cylinders so that as the piston is moved along the cylinder in conjunction with the motions of the individual's foot during an exercise or therapy routine, liquid flows between the interiors of the cylinders by way of the port. By controlling the flow of liquid between the interiors of the cylinders by way of the ports, the emotions of the individual's feet during the exercise or therapy routine can be controlled.

6 Claims, 3 Drawing Sheets

ATTACHMENT SYSTEM FOR SUSPENDING AN EXERCISE AND/OR THERAPY APPARATUS IN A POOL OF LIQUID

This is a divisional of application Ser. No. 08/638,500, filed Apr. 26, 1996 now pending.

BACKGROUND OF THE INVENTION

This invention relates generally to exercise and therapy apparatus which is used in conjunction with a liquid medium, such as water, and utilizes the liquid medium to resist or generate motions of an individual during an exercise or therapy routine.

One type of exercise apparatus with which this invention is concerned is an underwater ski-type exercise machine having feet-supporting members mounted for linear movement along guide tracks as the user simulates the motions of a cross country skier. As the feet-supporting members are moved along the guide track in response to the motions of the user's legs and feet, the water within which the exercise machine is positioned resists the movement of the feet-supporting members and, consequently, the exercise motions of the user. An example of such an underwater ski-type exercise machine is shown and described in U.S. Pat. No. 5,217,420.

It is an object of the present invention to provide a new and improved system for use with an exercise apparatus wherein the liquid of a pool is used to resist the motions of an individual during the performance of an exercise routine performed with the apparatus.

Another object of the present invention to provide such a system wherein the degree of resistance offered by the liquid medium to the exercise motions of the individual can be altered or wherein the motions generated with the use of the system for moving the limbs of an individual during a therapy routine can be altered.

Yet another object of the present invention is to provide such a system which is well-suited for use in conjunction with underwater exercise apparatus wherein the muscles of the user effect the movement of selected components of the apparatus or for use in conjunction with an underwater therapy device wherein motions generated with the aid of the system effect movement of selected limbs of the user.

Still another object of the present invention is to provide such a system which is well-suited for use in conjunction with an underwater ski-exercise apparatus.

A further object of the present invention is to provide such a system which is uncomplicated in construction, yet effective in operation.

A still another object of the present invention is to provide a new and improved ski-type exercise apparatus which utilizes the system of the invention.

SUMMARY OF THE INVENTION

This invention resides in a liquid resistance or therapy system for use in conjunction with the motions of an individual during the performance of an exercise or therapy routine wherein the system is positionable within a pool of liquid having walls and wherein the system utilizes the liquid of the pool for resisting or generating the motions of the individual during the exercise routine.

The system includes means defining a variable-volume chamber having an interior for containing liquid of the pool and a volume which increases and decreases in conjunction with the motions of the individual during the exercise or therapy routine. The variable-volume-defining means also include port means through which liquid enters and exits the interior of the variable-volume chamber as the volume thereof increases or decreases in conjunction with the motions of the individual during the exercise or therapy routine. The system also includes means associated with the variable-volume chamber for controlling the flow of liquid into and out of the interior of the variable-volume chamber by way of the port means so that by controlling the flow of liquid into and out of the variable-volume chamber as aforesaid, the motions of the individual during the exercise or therapy routine can be controlled.

In a particular embodiment of the invention, the system is utilized in a ski-type exercise or therapy apparatus enabling a user to simulate motions of a cross country skier while exercising in liquid-filled pool. In such an embodiment, the apparatus includes a frame positionable in a stationary condition with respect to the walls of the pool and means defining a pair of variable-volume chambers associated with the frame wherein each variable-volume chamber includes an interior for containing liquid of the pool and a volume which increases and decreases in conjunction with the motions of a corresponding foot of the individual between two positions of movement during the exercise routine. Port means are associated with each of the variable-volume chambers through which liquid enters or exits the interior of the variable-volume chambers as the volumes thereof increase or decrease in conjunction with the motions of the individual during the exercise or therapy routine. The apparatus also includes means associated with the ports of the variable-volume chambers for controlling the flow of liquid into or out of the interior of the variable-volume chambers by way of the port means so that by controlling the flow of liquid into and out of the chambers as aforesaid, the motions of the individual's feet during an exercise or therapy routine can be controlled.

DETAILED DESCRIPTION OF THE ILLUSTRATED EMBODIMENT

Figure 1:
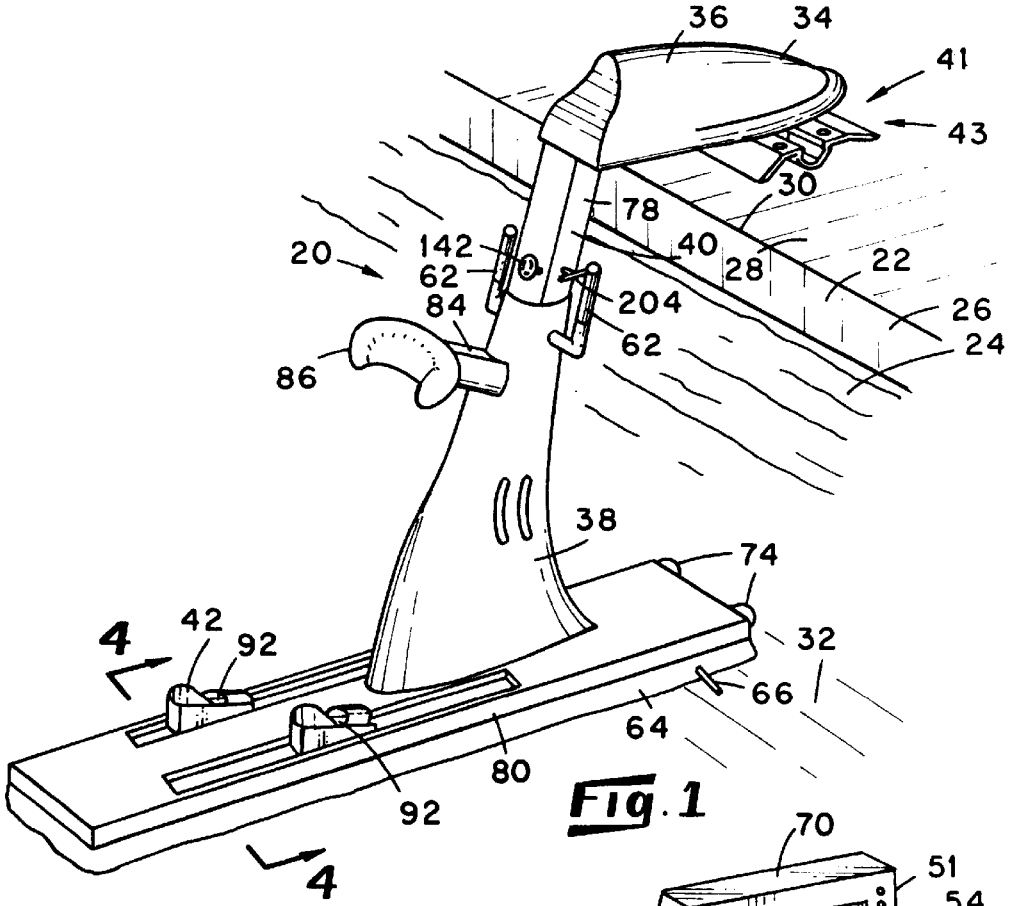
FIG. 1 is a perspective view of an embodiment of an apparatus shown positioned within a pool of water for use.
Figure 2:
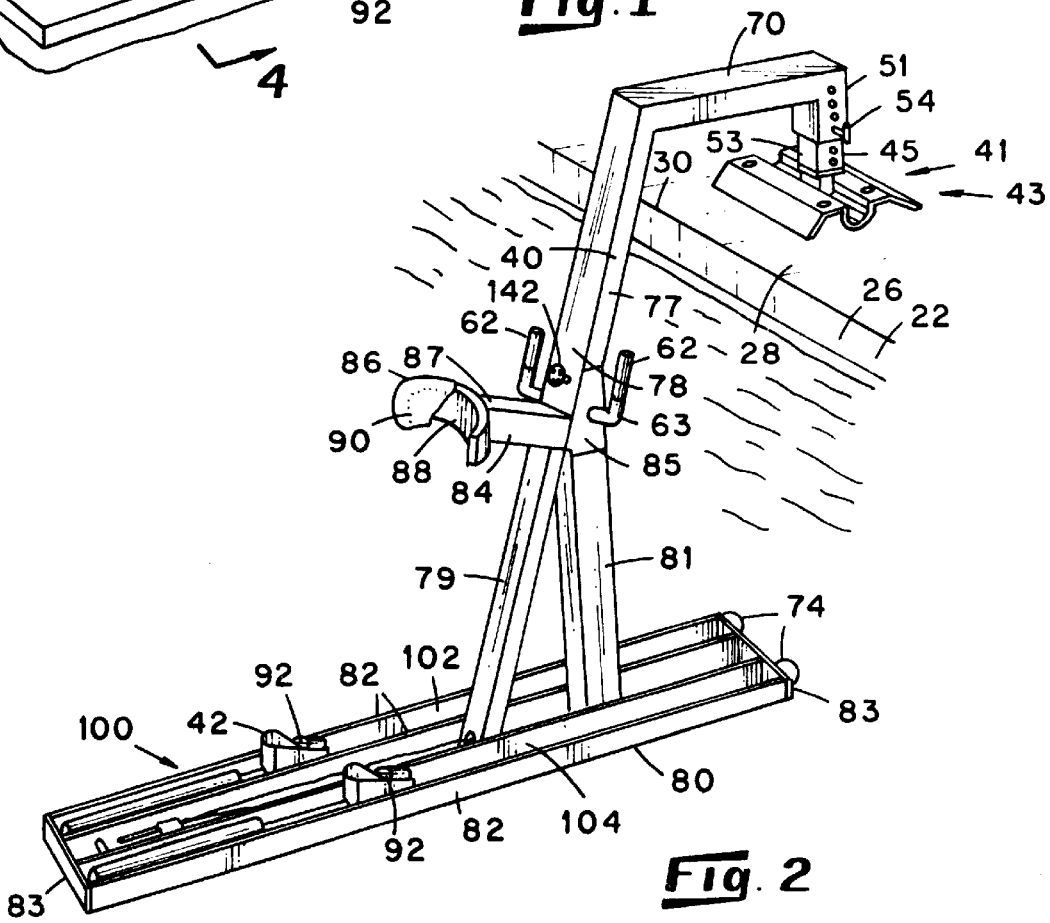
FIG. 2 is a perspective view of the FIG. 1 embodiment, shown with its outer shell removed therefrom and shown partially cut-away.

Turning now to the drawings in greater detail, there is shown in FIGS. 1 and 2 an embodiment, generally indicated 20, of an exercise apparatus shown positioned within an environment of intended use. In particular, the exercise apparatus 20 is shown anchored adjacent a side of a pool 22 of water 24 so that a substantial portion of the apparatus 20 is positioned within the water 24 of the pool 22. The depicted pool 22 includes a planar, substantially vertically-disposed sidewall 26 and a flat, horizontal walkway 28 which joins the sidewall 26 along an upper edge 30 of the pool 22, and a bottom 32. The apparatus 20 includes a frame 40 (best shown in FIG. 2) which is attached to the walkway 28 in a stationary relationship with the sidewall 26 and bottom 32 of the pool 22 and a ski section 42 mounted upon the frame 40 so as to be positioned entirely beneath the upper level of the pool water 24.

Although the apparatus 20 is shown and described for use during the performance of an exercise routine wherein the movements of an individual effect a corresponding movement of selected components of the apparatus 20, it will be understood that the apparatus 20 can be used during the performance of a therapy routine wherein motions generated with selected components of the apparatus 20 effect corresponding movements of an individual. Accordingly, the principles of the present invention can be variously applied.

The frame 40 is housed within an outer shell 34 having an upper portion 36 which is positioned about the upper portion of the frame 40 and a lower portion 38 which substantially encloses selected portions of the apparatus frame 40 and the ski section 42. The shell 34 renders the apparatus 20 relatively attractive in appearance and, as will be apparent herein, its lower portion 38 helps to stabilize the apparatus 20 during operation. The shell 34 of the depicted embodiment 20 is comprised of molded plastic sections which are attached about the frame 40 so as to provide a hollow skin thereabout.

For purposes of securing the apparatus 20 in place within the pool 22 and with reference to FIGS. 1–3 and 3*a,* the depicted apparatus 20 includes an attachment system 41 including means, generally indicated 43, which is connectable to the pool walkway 28 in a stationary condition with respect thereto and a downwardly-depending section 45 associated with the frame 40 which cooperates with the connectable means 43 in a manner which permits the remainder of the frame 40 to be supported from the walkway 28 and over the pool edge 30. In this connection, the frame 40 includes an upper portion having an horizontally-oriented beam 70 and a vertical (hollow) section 51 joined to an end of the beam 70 so as to be disposed generally over the walkway 28.

The downwardly-depending section 45 of the depicted embodiment 20 includes a square channel section 53 which is slidably received within the vertical section 51 and which is retained therein with a pin 54 extending through aligned openings provided in the sections 51 and 53. The vertical position of the vertical section 51 (and consequently the remainder of the frame 40) can be vertically adjusted by removing the pin 54 from one set of aligned openings, vertically shifting the sections 51 and 53 relative to one another and then reinstalling the pin 54 within an alternative set of openings.

Figure 3:
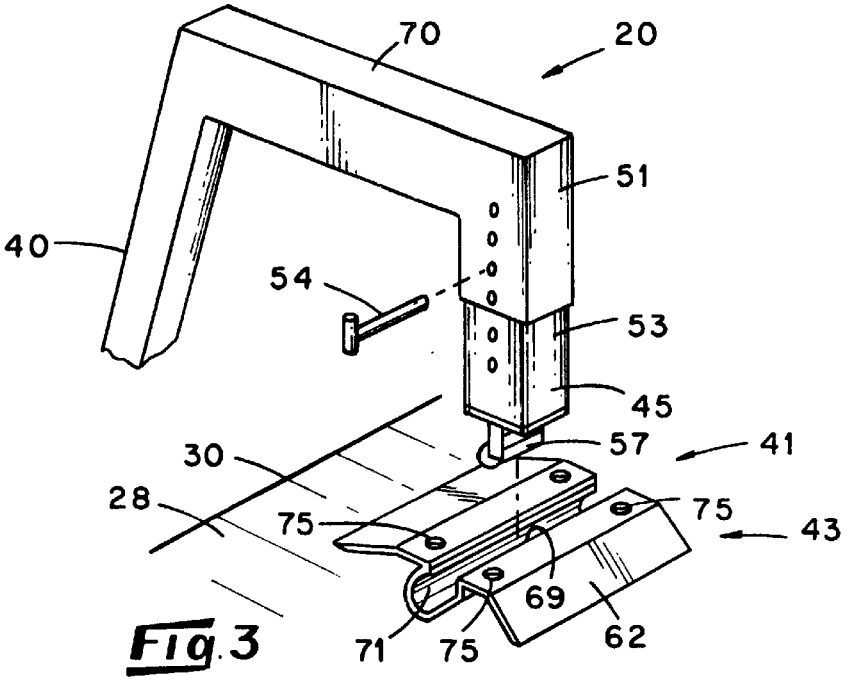
FIG. 3 is a perspective view of a fragment of the frame of the FIG. 1 apparatus, shown exploded.
Figure 3A:
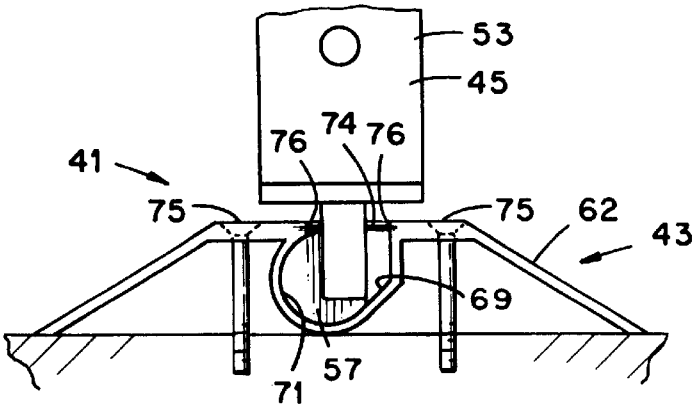
FIG. 3*a* is a side elevational view of a portion of the FIG. 3 fragment, shown assembled.

With reference to FIG. 3*a,* the downwardly-depending section 45 also includes an elongated, linear member 57 which is fixedly attached to so as to be disposed beneath the section 53. The member 57 is substantially circular in form as a path is traced about a major portion of its circumference, and as will be apparent herein, cooperates with the connectable means 43 to suspend the remainder of the frame 40 from the pool edge 30.

The connectable means 43 is in the form of an extruded member 62 (best shown in FIG. 3*a*) fixedly secured to the walkway 28 with screws 75 and having an upper surface within which is formed a generally upwardly-opening recess 69. This recess 69 is adapted to accept the elongated member 57 of the downwardly-depending section 45 when the member 57 is lowered therein. To this end, the recess 69 has an internal surface portion 71 which is shaped generally complementary to the outer surface of the member 57 so that when received therein, the member 57 is nestingly received by the recess 69 and so that the downwardly-depending section 45, and thus the remainder of the frame 40, is permitted to pivot about the member 57 between alternative positions. The member 57 is releasably secured within the recess 69 with a thin plate-like member 74 slidably positioned within opposing grooves 76 formed within the surface of the recess 69 and generally above the member 57 to releasably secure the member 57 within the recess 69.

With reference again to FIGS. 1 and 2, the lower portion of the frame 40 is provided with a pair of cushioned, spaced-apart feet 74 (FIGS. 1 and 2) which are adapted to abut the sidewall 26 of the pool 22 as the frame 40 tends to pivot about the elongated member 57 under the weight of the frame 40. In addition, the beam 70 can be divided along its length with a pair of opposing plates (not shown) which can be shifted in position relative to one another to accommodate an adjustment in the vertical position of the suspended portion of the frame 40 relative to the pool edge 30.

With reference again to FIG. 2, the frame 40 also includes a beam assembly 78 including a main beam 78 which is joined at one (i.e. an upper) end to the end of the beam 70 opposite the attachment system 41 so as to extend generally downwardly therefrom and a secondary beam 79 which is joined in an end-to-end arrangement with the main beam 78 so that the longitudinal axes of the main and secondary beams 78 and 79 are substantially aligned with one another. Each of the beams 78 and 79 has a hollow interior within which tubing is housed for conducting water from the ski section 42 and a manually-operable valve 142 mounted within the beam 78. Supported at the lower end of the beam 79 is a substantially rectangular base section 80 which is arranged so that its planar arrangement is oriented substantially horizontally. The base section 80 includes a plurality of parallel members 82 which provide elongated guide tracks (described herein) extending lengthwise of the section 80 and a pair of platen members 83 which are joined to and extend across the ends of the parallel members 82. The aforementioned feet 74 are attached to and are directed away from the end of the base section 80 closest the pool sidewall 26 for abuttingly engaging the sidewall 26 when the apparatus 20 is operatively positioned within the pool 22 as illustrated in FIG. 1. An additional brace beam 81 is joined between the main beam 78 and the base section 80, and side plates 85 (only one shown in FIG. 2) are secured across the ends of the main and brace beams 78, 81 to help rigidify the beam assembly 78.

Still further, the frame 40 includes a linear member 84 joined at one end to the main beam 78 so as to be cantilevered therefrom and a pelvic support 86 attached at the end, indicated 87, of the member 84 opposite the main beam 78. The pelvic support 86 includes an arcuate metal (e.g. aluminum) inner support 88 which is fixed in position to the member end 87 and a padded cover 90 secured across so as to cover the inner support 88. If desired, the pelvic support 86 can be made to be vertically-adjustable relative to the frame to accommodate a vertical shift of position in the support 86. As will be apparent herein, the apparatus 20 is intended to operate as a ski-exercise device in that during use, the feet of an individual are supported atop of the base section 80 as the individual faces the pool sidewall 26 and while he urges his feet forwardly and rearwardly along the base section 80 with the stride-like motions of a cross-country skier. During the performance of such an exercise routine, the pelvic support 86 provides an abutment surface against which the pelvic region of the user is positioned.

The frame 40 also includes a set of handlebars or grips 62 which are mounted forwardly of the pelvic support 86 which are intended to be gripped during the performance of an exercise routine to enhance the stability of the user as he moves his feet along the base section 80. In the depicted apparatus 20, the grips 62 include a pair of generally vertically-oriented bars 63 which are fixedly attached to opposite sides of the main beam 78 so that the grips 62 are maintained in a stationary condition with respect thereto.

Each component of the attachment system 41, as well as the beams and related support members of the frame 40 are comprised of a suitable material, such as aluminum, but other materials can be used. A frame 40 constructed primarily of aluminum has been found to weigh no more than about one-hundred pounds, and since the apparatus 20 may be required to be, on occasion, physically removed from and subsequently re-installed within the pool 22, its lightweight nature is advantageous in this respect. To facilitate the raising and lowering of the frame 40 within the pool 22, an air-inflatable rubber-like envelope 64 (best shown in FIG. 1) may be secured beneath the underside of the base section 80. A valve 66 associated with the envelope 64 permits air to be pumped into the envelope with, for example, an air compressor or pump (not shown) positioned upon the pool walkway 28, and the air pumped into the envelope 64 will render the frame 40 considerably lighter and easier to manipulate when the frame 40 is positioned within the water 24 of the pool 22.

In order to mount the apparatus 20 within the pool 22, the extruded member 62 of the securement system 41 is initially secured along the edge 30 of the pool 22 with the screws 75. The frame 40 is then lowered into the water of the pool 22, and the main beam 78 of the frame 40 is manipulated so that the upper beam 70 is hooked within the recess 69 of the extruded member 62 by way of the elongated member 57, and the elongated member 57 is releasably secured within the recess 69. With the main beam 78 of the frame 40 hooked to the extruded member 43 in this manner, the frame 40 is subsequently lowered into the water (as the frame 40 pivots about the member 62) until the feet 74 of the frame 40 abut the sidewall 26 of the pool 22. If necessary, adjustments can be made by way of the sections 51 and 53 and pin 54 to appropriately position the base section 80 in a substantially horizontal orientation for use.

Figure 4:
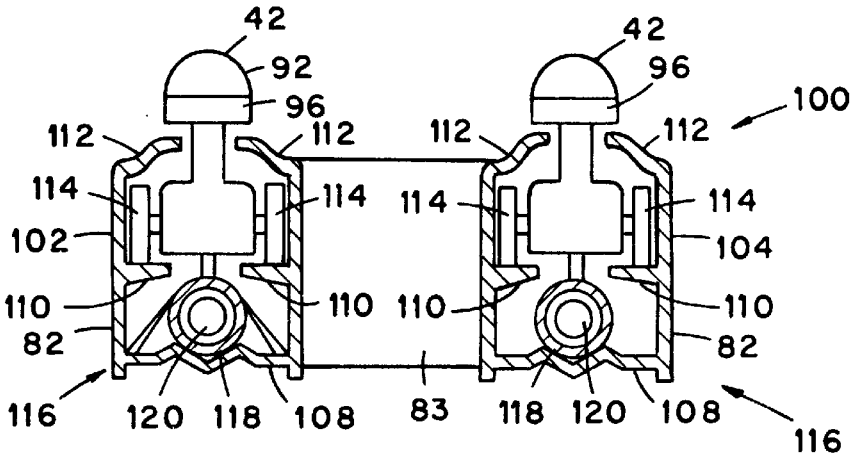
FIG. 4 is a cross-sectional view of the ski section of the FIG. 1 apparatus taken about along line 4—4 of FIG. 1.
Figure 5:
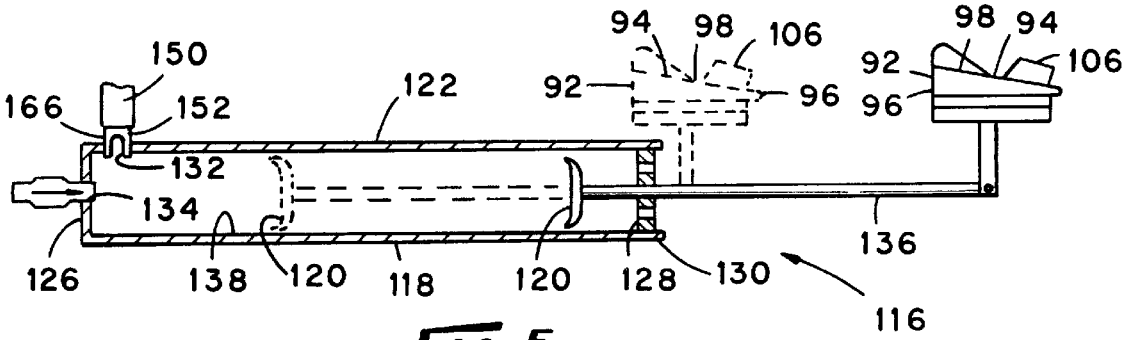
FIG. 5 is a longitudinal cross-sectional view of one of the ski and pump assemblies of the FIG. 1 apparatus.

With reference to FIGS. 4 and 5, the ski section 42 includes a pair of foot-supporting assemblies 92 for supporting feet of the user when the apparatus 20 is being used and also includes means, generally indicated 100, providing a pair of guide tracks 102, 104 within which the foot-supporting assemblies 92 are captured for movement therealong. Each foot-supporting assembly 92 includes a platform section 94 having a body 96 including an upper surface 98 upon which a user's foot is positioned during use and strap means 106 secured on opposite sides of the platform body 96 so as to extend across the upper surface 98 thereof and providing, with the upper surface 98, an opening for accepting the foot of the user when directed toe-end-first therein. Preferably, the upper surface 98 is shaped to conform generally with the shape of the underside of the user's foot to enhance the comfort of the user when the foot is positioned thereon.

Each guide track 102 or 104 is provided by a corresponding pair of linear members 82 of the base section 80. Each linear member 82 is in the form of an elongated, extruded channel member 108 having legs 110, 112 which provide somewhat of a U-shaped cross section, as best viewed in FIG. 4. Each pair of channel members 108 are secured in substantially parallel relation by the aforementioned platen members 83 (FIG. 2) joined across the ends thereof so that the Us of each pair of members 108 (FIG. 4) are positioned so as to oppose one another, and the U-shaped sections of the channel members 108 cooperate with the foot-supporting assemblies 92 to accommodate movement of the assemblies 92 relative to and along the length of the guide tracks 102, 104. To this end, a set of wheels 114 are rotatably attached to the opposite sides of the body 96 of each platform section 94 and which are accepted by the Us formed between the legs 110, 112 of the opposing pair of channel members 108 so as to rest upon the legs 110. Thus, when a foot is positioned within one of the foot-supporting assemblies 92 and the assembly 92 is moved relative to and along the length of the corresponding guide track 102 or 104, i.e. forwardly and rearwardly relative to the frame 40, the wheels 114 roll along the surfaces of the legs 110 of the channel members 108.

The apparatus 20 also includes means, generally indicated 116, for resisting the motion of the foot-supporting assemblies 92 as the assemblies 92 are moved in at least one direction along the length of the guide tracks 102, 104. In the depicted apparatus 20, such means 116 includes a pair of pump assemblies 118 including a piston 120 and a cylinder 122 within which the piston 120 is slidably received and a flow control system 124 associated with the cylinder 122 for controlling the flow of pool water into and out of the cylinder 122 in response to movement of the foot-supporting assemblies 92 along the length of the guide tracks 102, 104. Each cylinder 122 is tubular in form and is suitably strapped in a stationary condition between a corresponding set of channel members 108 (FIG. 4). In addition and as best shown in FIG. 5, each cylinder 108 is closed at one end 126, i.e. its rearward end, and includes an spoke-like member 128 secured in its opposite end 130, i.e. its forward end, wherein the spoke-like member 128 is provided with a plurality of apertures, as well as a central opening therein. As long as the pump assemblies 118 are positioned within the water of the pool 22, the pool water has access to the interior of the cylinder 122 through the apertures provided in the spoke-like member 128. The cylinder 122 is also provided with a pair of openings 132, 134 disposed adjacent the cylinder end 126 whose purpose will become apparent herein.

The piston 120 is plug-like in form and is sized to be slidably accepted by the interior of the cylinder 122 for movement between the ends 126 and 130 thereof. The piston 120 is joined to a corresponding foot-supporting assembly 92 by way of a rod 136 connected at its opposite ends to the piston 120 and platform section 94 of the assembly 92 and extends through the central opening provided in the spoke-like member 128. Together, the interior surfaces of the cylinder 122 and the head of the piston 120 provide a variable-volume chamber 138 which increases or decreases in volume as the piston 120 is moved forwardly or rearwardly along the length of the cylinder 122.

Each variable-volume chamber 138 is arranged relative to the frame 40 so that as the foot-supporting assembly 92 is moved rearwardly relative to the frame 40, the piston 120 is moved rearwardly, i.e. toward the left as viewed in FIG. 5, along the interior of the cylinder 122, and as the foot-supporting assembly 92 is moved forwardly relative to the frame 40, the piston 120 is moved forwardly, i.e. toward the right as viewed in FIG. 5, along the interior of the cylinder 122. As the piston 120 is moved rearwardly along the length of the cylinder 122, water positioned within the variable-volume chamber 138 is urged out of the chamber 138 by way of the opening 132 in a manner described herein while water is permitted to enter the cylinder 122 on the forward side of the piston 120 substantially unrestricted through the spoke-like member 128. Conversely, as the piston 120 is moved forwardly along the length of the cylinder 122, water is drawn into the variable-volume chamber 138 by way of the openings 132 and 134 while water disposed within the cylinder 122 and on the forward side of the piston 120 is urged out of the forward end 130 of the cylinder 122 substantially unrestricted through the spoke-like member 128.

Figure 6:
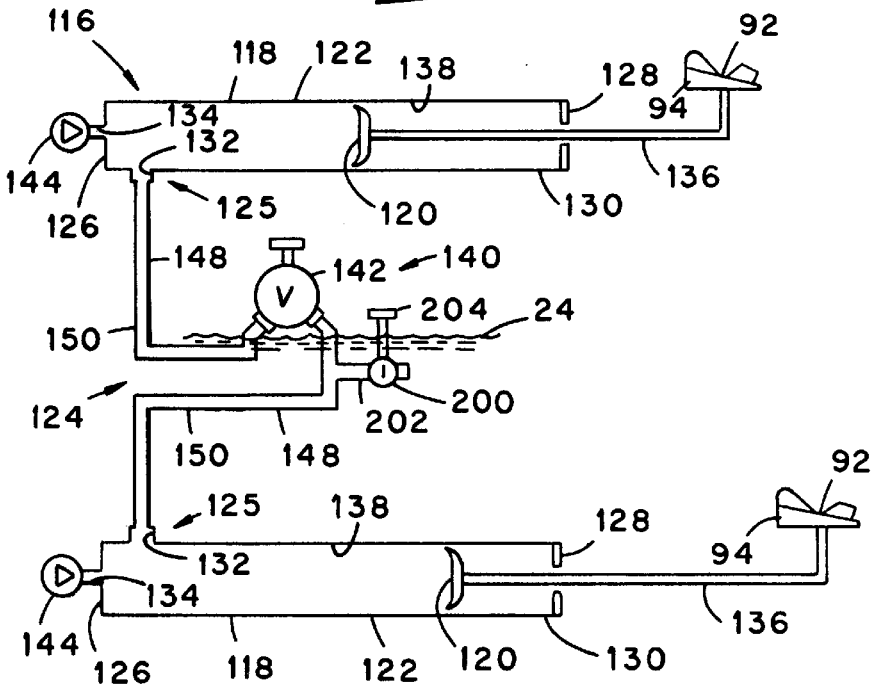
FIG. 6 is a schematic view of the flow control system of the ski-section of the FIG. 1 apparatus.

With reference to FIG. 6, the flow control system 124 associated with the cylinder 122 includes port means 125 through which water enters and exits the variable volume chamber 138 as the pistons 120 are moved (by the user) along the length of the cylinder 122 and valve means, generally indicated 140, associated with the port means 125 for controllably restricting the flow of water through the port means 125 during operation of the apparatus 20. In the depicted apparatus 20, the port means 125 is provided by the opening 132 provided in each cylinder 122, and the valve means 140 includes a manually-operable valve 142 and a check valve 144. In addition, a network 148 of tubing is connected between the opening 132 of each cylinder 122 and the manually-operable valve 142, and each check valves 144 is connected in flow communication with the chamber opening 132 to accommodate a flow of water therethrough in only one direction.

The manually-operable valve 142 is affixed to the frame 40 of the apparatus 20 adjacent the hand grips 62 (best depicted in FIGS. 1 and 2) to be readily accessible to the user and is connected in-line with the tubing network 148 so that water flows through the valve 142 between the chambers 138 by way of the chamber openings 132 in response to the movement of the pistons 120 along the length of the cylinders 122. The valve 142 may be any of a number of types of valve, such as a gate valve or a globe valve, and is preferably constructed of plastic (rather than metal) to resist corrosion. As will be apparent herein, the valve 142, or more specifically, the restriction to the flow of water therethrough, is adjusted to a setting which accommodates a preselected quantity of the flow of water therethrough so that as either of the foot-supporting assemblies 42 is urged rearwardly along the length of the guide tracks 102, 104 under the power of the user, only about that preselected quantity of water flow is permitted to be discharged into the other cylinder 122 through the valve 142. Consequently, by adjusting the restriction to the quantity flow of water through the valve 142, the amount of effort which must be expended by the user in order to move each foot-supporting assembly 92 rearwardly along the length of its corresponding cylinder 122 is altered. In other words, the greater the restriction to the flow of water through the valve 142, the greater the amount of effort which must be expended by the user to move each foot-supporting assembly 92 rearwardly along the cylinder 122.

The operation of the flow control system 124 of the apparatus 20 can be best understood with reference to the system schematic of FIG. 6 depicting the connections of the manually-operable valve 142 within the tubing network 148 and the connection of the check valves 144 to the cylinders 122. In this connection, the operation of the flow control system 124 (in conjunction with the pump assemblies 118) is intended to render each foot-supporting assembly 92 relatively hard to move when urged rearwardly along its corresponding guide track 102 or 104 and to render each foot-supporting assembly 92 relatively easy to move when urged forwardly along the guide track 102 or 104. To this end, the tubing network 148 includes a pair of tube sections 150 wherein each section 150 is joined between the cylinder opening 132 by way of a nipple 152 (FIG. 5) and a corresponding inlet port of the manually-operable valve 142. In addition, each check valve 144 is secured to the chamber opening 134 to permit substantially unrestricted flow of water into the chamber 138 by way of the opening 132 while preventing any flow of water out of the chamber 138 by way of the opening 134.

It follows from the foregoing that as one of the foot-supporting assemblies 92 is urged rearwardly along its corresponding guide track 102 or 104 so that the water disposed in the corresponding variable-volume chamber 138 is urged out of the cylinder opening 132 toward the other chamber 138, the exiting water can only flow through the manually-operable valve 142. By therefore setting the valve 142 to appreciably restrict the flow of water therethrough, the effort which must be expended by the user to urge to water from the variable-volume chamber 138 is great. Conversely, upon moving the foot-supporting assembly 92 forwardly along the corresponding guide track 102 or 104 so that the piston 120 is moved forwardly along the length of the cylinder 122, water is drawn into the variable-volume chamber 138 by way of the check valve 144 (as well as through the opening 132 as water is discharged from the other chamber 138) so that the effort which must be expended by the user to move the foot-supporting assembly 92 forwardly along the guide track 102 or 104 is relatively small. The flow of water through the tubing network 148 (by way of the opening 132) into the variable-volume chamber 138 whose piston 120 is being urged forwardly is believed to aid the forward motion of the piston 120 and is advantageous in this respect.

During the normal use of the apparatus 20 during which the user's motions simulate that of a cross-country skier, the rightward foot-supporting assembly 92 is moved rearwardly as the leftward foot-supporting assembly 92 is moved forwardly, and the leftward foot-supporting assembly 92 is moved rearwardly as the rightward foot-supporting assembly 92 is moved forwardly. Thus, during normal operation of the apparatus 20, only one leg at a time must expend the required effort to urge its foot-supporting assembly 92 rearwardly from a forward position while the other leg returns (with relative ease) its corresponding foot-supporting assembly 92 forwardly toward its forward position. As the user simulates the motions of a cross-country skier in the aforedescribed manner, his pelvic region is positioned against the pelvic support 86 (FIGS. 1 and 2) so that the pelvic support 86 opposes the forces which would otherwise urge the user's body forwardly in response to the force expended by his legs to urge the foot-supporting assemblies rearwardly along the guide tracks 102, 104.

An additional advantage provided by the flow control system 124 relates to the positioning of the user's feet within the foot-supporting assemblies 92 as the user prepares to use the apparatus 20. In this connection and with reference again to FIG. 6, the system 124 includes a two-position valve 200 mounted in a tube 202 which, in turn, is connected in flow communication with one of the tubes 150 of the tube network 148. The valve 200 can be adjusted between a fully-open position and a fully-closed position by way of the manual actuator 204 which is accessible to a user of the apparatus 20. By positioning the valve 200 in its fully open position, water is permitted to enter or leave the chambers 122 substantially unrestricted so that each of the foot-supporting assemblies 92 can be easily shifted along the length of its guide track 102 or 104 and independently of the other foot-supporting assembly 92. It has been found that the feet are easier to manipulate within the foot-supporting assemblies 92 while the foot-supporting assemblies 92 are permitted to shift freely along the length of its guide track 102 or 104 and independently of one another. Therefore, by opening the two-position valve 200 before the user's feet are positioned within the foot-supporting assemblies 92, the user can more easily position his feet within the foot-supporting assemblies 92 for use. Once the feet are positioned within the assemblies 92, the two-position valve is re-adjusted to its closed position for use of the apparatus 20.

Another advantage provided by the apparatus 20 relates to the substantially enclosed condition of the lower portion of the apparatus frame 40 by the lower portion of the shell 34 (FIG. 1). In particular, as long as the apparatus 20 is positioned within the pool water 24, the lower portion of the shell 34, while not water-tight, holds water therein in a generally captured condition. This capturing of the water by the shell 38 provides an inertia against any sideways shifting of the frame 40 which may otherwise result as the foot-supporting assemblies 92 of the ski section 42 are alternately urged rearwardly along the guide tracks 102, 104 during an exercise routine performed with the apparatus 20, and the shell 38 is advantageous in this respect.

Figure 7:
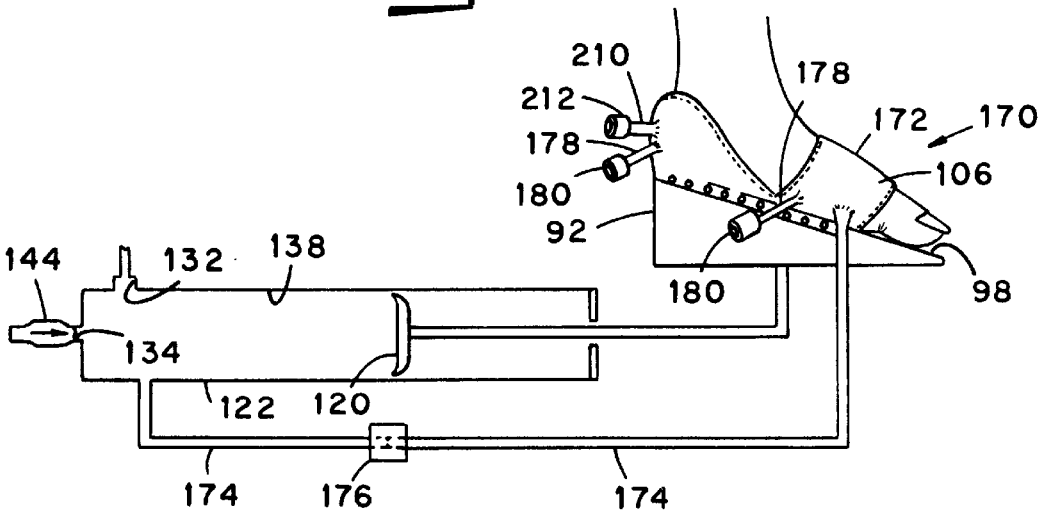
FIG. 7 is a view illustrating schematically a scheme by which each foot of the user is captured within a foot-supporting assembly of the FIG. 1 apparatus during use.

With reference to FIG. 7, the apparatus 20 also includes means, generally indicted 170, associated with the foot-supporting assemblies 92 for snugly maintaining the user's feet in a captured condition against the upper surface 98 of the platform sections 94 during operation of the apparatus 20. In the depicted apparatus 20, such means 170 includes a distensible envelope in the form of an inflatable bladder 172 embodied within the strap means 106 of each foot-supporting assembly 92 and shaped so as to encircle the heel of the foot and conduit means 174 joined between the bladder 172 and the corresponding pump assembly 118. The conduit means 174 permits flow communication between the interior of the variable-volume chamber 138 of the corresponding pump assembly 118 and the interior of the bladder 172. Connected in-line with the conduit means 174 is a flow restrictor 176, and associated with the bladder 172 is a first outlet vent 178 which includes a flow restrictor 180 and a second outlet vent 210 which includes a pop-off valve 212.

Upon inflation of the bladder 172 and as will be apparent herein, the bladder 172 expands and tightens against the surface of the user's foot in a manner which snugly holds the foot upon the upper surface 98. Since the user's foot could be bare when positioned within the foot-supporting assembly 92, it is preferable that the outer surface of the bladder 172 be covered with a smooth and relatively soft material.

During operation of the apparatus 20, the internal pressure of the variable-volume chamber 138 of each pump assembly 118 will, on the average, be positive. This positive pressure will effect a flow of water from the variable-volume chamber 138 to the interior of the bladder 172 by way of the conduit means 174 for inflating the bladder 172 across the user's foot. It will be understood, however, that the internal pressure of the variable-volume chamber 138 will normally be greater than the pressure needed (or desired) to be sensed by the bladder 172. To therefore protect the bladder 172 from the high pressures developed in the chamber 138, the flow restrictor 176 effects a reduction in the pressure along the conduit means 174 between the side thereof corresponding with the variable-volume chamber 138 and the side thereof corresponding with the bladder 172 and the pop-off valve 212 is adapted to permit water flow through the vent 210 when the internal pressure of the bladder 172 is as high as a preselected, e.g. about 5.0 psig, pressure.

The magnitude of the flow restrictions provided by the flow restrictor 176 (situated upstream of the bladder 172) and the flow restrictor 180 (situated downstream of the bladder 172) are selected to provide a desired internal pressure therein intended to sufficiently inflate the bladder 172 and maintain the bladder 172 in an inflated condition across the user's foot so that the foot is snugly held between the surface of the bladder 172 and the upper surface 98 of the foot-supporting assembly 92 during an exercise routine performed with the apparatus 20. With the foot captured within the foot-supporting assembly 92 in this manner, the foot-supporting assembly 92 is firmly held upon the foot as the foot is moved forwardly and rearwardly to shift the foot-supporting assembly 92 forwardly and rearwardly along the length of the corresponding guide track 102 or 104.

When preparing to use the apparatus 20, the user climbs into the water and situates himself behind the pelvic support 86 (FIGS. 1 and 2). The user then positions his feet (one-at-a-time) within the foot-supporting assemblies 92 (FIG. 7) so that each foot is positioned between the upper surface 98 and the strap means 106. Each bladder 172 is in a deflated condition at the outset of an exercise routine so that the spacing provided between the strap means 106 and the upper surface 98 readily accepts the foot of the user when inserted toe-end-first therein. The user then begins to shift the foot-supporting assemblies 92 forwardly and rearwardly relative to the guide tracks 102, 104, as appropriate, to increase the internal pressure of the variable-volume chambers 138, and thereby expand the bladders 172 about to thereby capture the user's feet. The pop-off valve 212 is advantageous in that it speeds up the build-up of the internal pressure within the bladder 172 if, for example, the foot-supporting assemblies 92 are shifted relatively slowly along the guide tracks yet permits a prompt discharge of water from the bladder 172 if, for example, the foot-supporting assemblies 92 are shifted so rapidly that the internal pressure of the chambers 122 is not adequately reduced by the aforedescribed flow restrictor 176.

Upon completion of an exercise routine performed with the apparatus 20, the user of the apparatus 20 will, of course, cease to move the foot-supporting assemblies 92 in fore and aft directions along the guide tracks 102, 104, and the internal pressure of the bladders 172 will be permitted to equalize (by way of the vent 178) with that of the surrounding water so that the bladders 172 return to the deflated condition and relieve the bladder-applied pressure upon the feet. Thus, following cessation of the movement of the foot-supporting assemblies 92 along the guide tracks 102, 104 and the subsequent release of the feet by the bladders 172, the user may withdraw his feet from the foot-supporting assemblies 92.

It follows from the foregoing that the foot-holding means 170 of the apparatus 20 provides means by which a user can readily position his feet within the foot-supporting assemblies 92 for use of the apparatus 20 or withdraw his feet from the foot-supporting assemblies 92 upon completion of an exercise routine, as well as provide means for firmly holding the feet within the assemblies 92 during use of the apparatus 20. Moreover, the foot-holding means 170 obviates any need for the user to manually grasp or manipulate straps associated with the foot-supporting assemblies 92 to secure the feet thereto. Thus, the user need not bend over or dip his head beneath the level of the water in order to secure his feet to the foot-supporting assemblies 92, and the foot-holding means 170 are advantageous in this respect.

It will be understood that numerous modifications and substitutions can be had to the aforedescribed embodiment without departing from the spirit of the invention. For example, although the aforedescribed embodiment has been shown and described as including a manually-operable valve 142 by which the resistance to the rearward motions of the foot-supporting assemblies 92 can be altered, an apparatus in accordance with the broader aspects of the invention may employ an electrically-controlled valve responsive to an electrical setting of a switch mounted on a control panel. In addition, an apparatus may include a control computer mounted in, for example, the upper portion of the shell 38 and also include a viewable monitor which the user can view while performing his exercise routine with the apparatus 20. Such a monitor may include an LED display appropriately coupled to the pump assemblies 118 to provide, for example, a display of the stroke rate of the piston 120 and a comparison of the actual piston stroke rate to a target, or desired, stroke rate of the piston.

Furthermore, although the flow restrictors 176 and 180 of the aforedescribed foot-holding means 170 (FIG. 7) have been shown and described as providing a restriction at a single location along the length of its corresponding conduit 174 or vent 178, alternative flow restrictions can be provided by relatively narrow (capillary-like) tubing associated the conduit 174 or vent 178.

Still further and as mentioned earlier, the aforedescribed apparatus 20 can be used for the performance of a therapy routine wherein the feet are forcibly moved by motions generated in conjunction with the increase or decrease of the chamber volumes, rather than vise-versa. In such an instance, flow generating means, such as a pump, can be joined to the tubing network 148 and used in conjunction with suitable control means for cyclically directing water between the two chambers so that water flows in one direction between the two chambers for one period of time and then water flows in the opposite direction between the two chambers for another period of time.

In either event, however, the increase or decrease of the volumes of the variable-volume chambers 138 effect a corresponding movement of the foot-supporting assemblies 92 along the length of the guide tracks 108 or the movement of the foot-supporting assemblies 92 along the length of the guide tracks 108 effects a corresponding increase or decrease of the volumes of the variable-volume chambers 138, and the restriction of the flow of water into and out of the chambers 138 is largely responsible for the rate at which the pistons are (or can be) moved along the length of the cylinder 122. Accordingly, the aforedescribed embodiment is intended for the purpose of illustration and not as limitation.

We claim:

1. An attachment system for suspending an exercise or therapy apparatus within a pool of liquid having a wall and a generally upwardly-facing surface which meet at an edge of the pool and wherein the exercise or therapy apparatus includes a support frame and an abutting portion for abutting the wall of the pool when operatively positioned within the pool for use of the apparatus, the attachment system comprising:

means attachable to the support frame of the exercise or therapy apparatus including a downwardly-depending section which is arranged over the generally upwardly-facing surface of the pool when the apparatus is operatively positioned within the pool and the attachable means is attached to the support frame; and means connectable in a stationary relationship with the generally upwardly-facing surface of the pool and having a surface within which is defined an upwardly-opening recess adapted to accept the downwardly-depending section of the attachable means so that when the connectable means is connected to the generally upwardly-facing surface of the pool and the downwardly-depending section is accepted by the upwardly-opening recess, the support frame is supported from the connectable means and over the pool edge so that the abutting portion of the apparatus abuts the wall of the pool for use of the apparatus and wherein the upwardly-opening recess is adapted to permit a pivotal movement of the support frame of the apparatus between two positions about the downwardly-depending section of the frame.

2. The attachment system as defined in claim 1 wherein the downwardly-depending section includes a cooperating portion which is nestingly accepted by the upwardly-opening recess, and the upwardly-opening recess cooperates with the cooperating portion to permit the pivotal movement of the support frame relative to the connectable means between two positions and about a substantially horizontal axis.

3. The attachment system as defined in claim 2 wherein the upwardly-opening recess includes a linear section which is oriented substantially horizontally, and the cooperating portion is nestingly accepted by the linear section of the upwardly-opening recess to permit the pivotal movement of the support frame as aforesaid about the horizontal axis.

4. The attachment system as defined in claim 2 wherein the cooperating portion is substantially cylindrical in form, and the upwardly-opening recess has an internal surface which is shaped generally complementary to the cylindrical form of the cooperating portion so that as the support frame is pivoted relative to the connectable means about the horizontal axis as aforesaid, the surface of the cooperating portion slidably moves along the internal surface of the upwardly-opening recess.

5. The attachment system as defined in claim 1 further including means for releasably securing the downwardly-depending section within the generally upwardly-opening recess.

6. In combination, an exercise or therapy apparatus and an attachment system for suspending the exercise or therapy apparatus within a pool of liquid having a wall and a generally upwardly-facing surface which meet at an edge of the pool and wherein the exercise or therapy apparatus includes a support frame and an abutting portion for abutting the wall of the pool when operatively positioned within the pool for use of the apparatus, the attachment system comprising:

means associated with the support frame of the exercise or therapy apparatus including a downwardly-depending section which is arranged over the generally upwardly-facing surface of the pool when the apparatus is operatively positioned within the pool; and means connectable in a stationary relationship with the generally upwardly-facing surface of the pool and having a surface within which is defined an upwardly-opening recess adapted to accept the downwardly-depending section of the associated means so that when the connectable means is connected to the generally upwardly-facing surface of the pool as aforesaid and the downwardly-depending section is accepted by the upwardly-opening recess, the support frame is supported from the connectable means and over the pool edge so that the abutting portion of the apparatus abuts the wall of the pool for use of the apparatus and wherein the upwardly-opening recess is adapted to permit a pivotal movement of the support frame of the apparatus between two positions about the downwardly-depending section of the frame.

* * * * *